US009972421B2

(12) United States Patent
Jiang et al.

(10) Patent No.: US 9,972,421 B2
(45) Date of Patent: May 15, 2018

(54) FEP MODIFICATION TO REDUCE SKEW IN DATA COMMUNICATIONS CABLES

(75) Inventors: Qibo Jiang, Ephrata, PA (US); Paul Kroushl, Lancaster, PA (US)

(73) Assignee: NEXANS, Paris (FR)

( * ) Notice: Subject to any disclaimer, the term of this patent is extended or adjusted under 35 U.S.C. 154(b) by 0 days. days.

(21) Appl. No.: 12/846,880

(22) Filed: Jul. 30, 2010

(65) Prior Publication Data

US 2011/0278042 A1 Nov. 17, 2011

Related U.S. Application Data

(60) Provisional application No. 61/334,033, filed on May 12, 2010.

(51) Int. Cl.

| | |
|---|---|
| ***H01B 11/04*** | (2006.01) |
| ***H01B 11/02*** | (2006.01) |
| ***H01B 3/44*** | (2006.01) |

(52) U.S. Cl.

CPC ..... *H01B 11/02* (2013.01); *H01B 3/445* (2013.01)

(58) Field of Classification Search

CPC ..... H01B 3/00; H01B 11/04
USPC ..... 174/113 R, 110 FC
See application file for complete search history.

(56) References Cited

U.S. PATENT DOCUMENTS

| | | | | |
|---|---|---|---|---|
| 5,194,459 | A * | 3/1993 | Sato | C08J 9/32 428/313.3 |
| 5,770,820 | A * | 6/1998 | Nelson et al. | 174/113 R |
| 5,814,768 | A * | 9/1998 | Wessels et al. | 174/110 FC |
| 5,834,697 | A | 11/1998 | Baker et al. | |
| 5,936,205 | A * | 8/1999 | Newmoyer | 174/113 R |
| 6,064,008 | A * | 5/2000 | Craton | 174/110 FC |
| 6,884,481 | B1 * | 4/2005 | Reynolds et al. | 428/35.7 |
| 7,030,321 | B2 * | 4/2006 | Clark | 174/113 R |
| 7,625,974 | B2 * | 12/2009 | Jozokos | C08K 3/0008 524/406 |
| 2002/0004111 | A1 * | 1/2002 | Matsubara et al. | 428/34.4 |
| 2002/0195591 | A1 | 12/2002 | Ravet et al. | |
| 2005/0183878 | A1 * | 8/2005 | Herbort | H01B 11/1847 174/110 R |
| 2005/0286841 | A1 * | 12/2005 | Henry | 385/100 |

FOREIGN PATENT DOCUMENTS

| | | |
|---|---|---|
| JP | 04-288352 | * 10/1992 |
| JP | H09-031244 | 2/1997 |
| JP | 11025765 | * 1/1999 |
| KR | 2006 0094440 | 8/2006 |

OTHER PUBLICATIONS

International Search Report dated Oct. 31, 2011.
Provisional Refusal dated Jan. 26, 2018.

* cited by examiner

*Primary Examiner* — Chau N Nguyen
(74) *Attorney, Agent, or Firm* — Sofer & Haroun, LLP

(57) ABSTRACT

A cable includes a first twisted pair of insulated conductors having a first lay length and a second twisted pair of insulated conductors having a second lay length, where the second lay length is longer than the first lay length. At least one jacket covers the pairs. An additive is added to the insulation of the conductors of the second twisted pair so that the dielectric constant of the insulation of the conductors of the second twisted pair is raised relative to the dielectric constant of the insulation of the conductors of the first twisted pair resulting in a reduced skew between the first and second twisted pairs.

4 Claims, 2 Drawing Sheets

FEP MODIFICATION TO REDUCE SKEW IN DATA COMMUNICATIONS CABLES

RELATED APPLICATION

This application claims the benefit of priority from U.S. Provisional Patent Application No. 61/334,033, filed on May 12, 2010, the entirety of which is incorporated by reference.

BACKGROUND

Field of the Invention

The present arrangement relates to communication cables. More particularly, the present arrangement relates to data communication cables using modified insulation.

Description of the Related Art

In the communication industry, one type of a common communication cable is the LAN (Local Area Network) cable, formed from four pairs of conductors. The conductor pairs are made from two wires twisted around one another, commonly referred to as a twisted pair. Typical high speed communication cables may include a number of shielded or unshielded twisted pairs enclosed by an outer jacket.

One problem that typically confronts the construction of such cables is signal interference or crosstalk that can occur between twisted pairs within the cable as well as with interference from other signal sources outside the cable, in particular with unshielded twisted pairs running in adjacent cables. In order to reduce the incidences of cross talk, the twisted pairs in unshielded data communication cables have different twist rates from one another so that a typical four pair LAN cable will have 4 pairs each with a different twist rate.

However, due to the different twist rates for addressing crosstalk, another cable construction obstacle arises referred to as skew. For example, for any given length of cable, the same signal sent along two adjacent twisted pairs with different twist rates will reach the end of the cable at different times. This occurs because the twisting of one pair at a shorter lay length (higher twist rate) than another pair within the same cable will necessarily result in the physical conductor path in the shorter lay length pair being longer than the conductor path of the pair(s) with the longer lay length (slow rate of twist). This resultant time difference is known as skew.

The property of skew is not only influenced by the physical length of the conductors in the various pairs. The insulation used on the pairs also affects the speed of signal propagation. This effect is a result of the communication signal passing in part through the insulation on the conductor pairs, slowing the propagation rates. Thus, in the longer (shorter lay length) pairs, the dielectric coupling of the signal to the insulation slows the propagation rates.

Moreover, each polymer used for insulation has its own dielectric constant. Certain polymers have low dielectric constants with a corresponding lesser effect on the signal speed. An example of such a polymer is FEP (Fluorinated Ethylene Propylene Copolymer). Other polymers such as Polypropylene have higher dielectric constants and thus exhibit a greater negative effect on the signal speed. This further exacerbates the skew problem.

The way the prior art has addressed the problem of skew is to increase the relative signal propagation velocity in the slower pairs by foaming the insulation used on those pairs. By foaming the insulation, the dielectric constant is reduced, thus allowing the signal in the slow pairs (pairs with shorter lay length) to be faster relative to the faster pair (pair with the longest lay length) reducing the overall signal velocity difference in the cable pairs and thus reducing skew.

However, the foaming process has a number of disadvantages; it is expensive, causes reduced manufacturing line speeds (slow extrusion), is difficult to control and ultimately yields high scrap rates. In addition, foamed insulation is easier to crush and thus may lead to the cables/pairs failing the necessary crush resistance testing. In fact, the foamed insulation may even overly compress/crush during twining (of the conductors into pairs). As a result, the insulation on the foamed pairs must be oversized to compensate. This increases the overall diameter of the cable which creates problems for the end user since they typically prefer smaller diameter cables.

OBJECTS AND SUMMARY

The present invention overcomes these drawbacks by manipulating the electrical properties of the conductor insulation in the twisted pairs by compounding additives into the polymer and extruding these compositions onto wire as a primary coating of plenum cable twisted pairs to obtain regularized electrical performance between the pairs in a cable.

Instead of speeding up signal propagation in the slow pairs of a cable to reduce skew, as is the case in the prior art, the present arrangement introduces additives to the insulation in the fast pairs (longest lay length) to reduce the signal propagation speed to reduce skew. The main electrical property of the fast pairs is being manipulated by modifying the insulation material to manipulate the dielectric constant of the conductor insulation. In another arrangement, instead of, and possibly in addition to, using additives to slow the speed of propagation in the faster pairs, entirely different polymer insulation may be used on one or more of the pairs in the cable. By using polymers that exhibit different affects on the speed of propagation, the skew may be controlled in this manner as well.

The present invention uses typical extrusion processes, as opposed to foaming processes, thus yielding higher manufacturing line speeds, lower costs, better process control and reduced scrap rates. The crushing problem observed in the prior art with the foam products is greatly reduced and in many cases eliminated in the present arrangement and thereby permits the use of smaller diameter pairs which in turn reduces the size of the cable, yielding a preferred product for the end user.

To this end, the present arrangement is directed to a cable with a first twisted pair of insulated conductors having a first lay length. A second twisted pair of insulated conductors having a second lay length has insulation on the conductors of the pair, where the second lay length is longer than the first lay length. At least one jacket covers the pairs. An additive is added to the insulation on the conductors of the second twisted pair so that the dielectric constant of the insulation on the conductors of the second twisted pair is raised relative to the dielectric constant of the insulation on the conductors of the first twisted pair.

BRIEF DESCRIPTION OF THE DRAWINGS

The present invention can be best understood through the following description and accompanying drawings, wherein.

DETAILED DESCRIPTION

Figure 1:
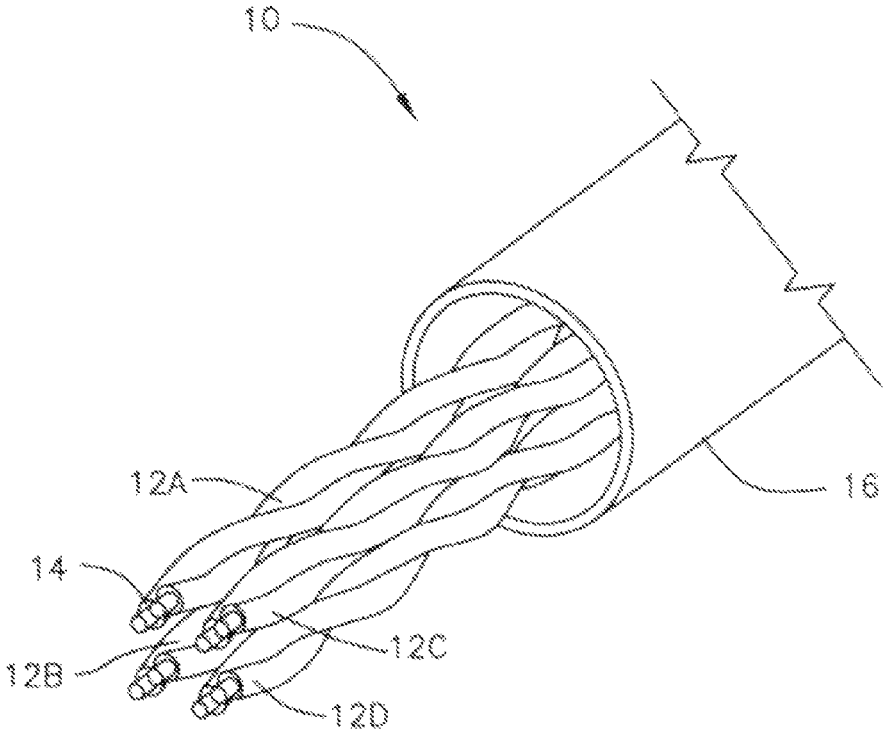
FIG. 1 shows an unshielded data communication cable having twisted pairs, in one embodiment.

In one arrangement, as shown in FIG. 1 a data communication cable 10 includes a plurality of twisted pair's 12*a-d*, each pair having a different lay length and each pair covered with an insulation coating 14. The bundle of twisted pairs is cabled and enclosed within a jacket 16.

For the purposes of illustration, the present arrangement is described as a typical eight wire LAN cable composed of four twisted pairs 12*a-d*. However, the invention is not limited in this respect. The principles of the present arrangement may be employed within smaller or larger twisted pair arrangements as well.

In the present arrangement, insulation coating 14 on each of twisted pairs 12*a*-12*d* is described as being FEP (Flouronated Ethylene Polymer). However, the invention is not limited in this respect. The principles of the present arrangement may be employed with other insulation polymers as well, including but not limited to PE (Polyethylene), PP (Polypropylene), PTFE (Polytetrafluoroethylene), ECTFE (Ethylene Chlorotrifluoroethylene), ETFE (Ethylene Tetrafluoroethylene), PFA, MFA, PPO (Polyphenylene Oxide), PPS (Polyphenylene Sulfone), PEEK (Polyether Ether Ketone), PET (Polyethylene Terephthalate), PBT (Polybutylene Terephthalate), PA (Polyamide ex. Nylon), PEI (Polyether Imide), PU (Polyurethane), TPE (Thermoplastic Elastomer), and TPV (Thermoplastic Vulcanizate). For the purposes of illustration, jacket 16 can be any typical polymer used for LAN cables or other similarly constructed cables.

As presented in the Background section, in order to minimize cross-talk between adjacent twisted pairs 12 within LAN cable 10, adjacent twisted pairs 12 have varying twist rates, and thus have varying lay lengths. The varying lay lengths of twisted pairs 12 relative to one another, result in different conductor lengths per pair 12, per unit of length of cable 10, thus resulting in signals propagating through the various pairs to reach the end of cable 10 at different times. Twisted pairs 12 having a high twist rate (short lay length) take a longer time to reach the end of the cable. This condition is the main contributing factor to skew in twisted pair cables.

In one embodiment, as shown in FIG. 1, cable 10 has 4 twisted pairs 12*a*-12*d* each having a different lay length from one another. For example, in a typical LAN cable 10 meeting the standards of CAT 5e 4 pair UTP (Unshielded Twisted Pair), the lay lengths of pairs 12*a*-12*d* range from 0.5 inch (shortest lay length–slowest pair) to about 0.9 inch (longest lay length–fastest pair). As noted above, one pair, namely twisted pair 12*a*, has a high twist rate (shortest lay length of 0.5 inches), with adjacent twisted pairs 12*b*-12*d* each having lower twist rates (longer lay lengths of 0.55 inches (12*b*), 0.75 inches (12*c*), and 0.9 inches (12*d*).

It is noted that the above sample lay lengths are for illustration purposes only. Any series of different lay lengths within a LAN cable may utilize the features of the present arrangement.

As a result of the above sample lay lengths for pairs 12*a*-12*d*, a signal propagating along pair 12*a* will take longer to reach the end of cable 10 than the signals moving through pairs 12*b*-12*d*. In fact, pair 12*d*, having the longest lay length will take the shortest amount of time to reach the end of cable 10. In this arrangement pair 12*a* exhibits the greatest difference with pair 12*d* (as well as differences with 12*b* and 12*c*) resulting in the cable skew According to the present arrangement, in order to reduce the skew in cable 10 between twisted pairs 12*a* and pairs 12*b*-12*d* the FEP coating 14 is modified by the addition of an additive, which is extruded onto the fastest pair 12*d* which increases the dielectric constant of that fastest pair thereby slowing down the velocity of propagation, so that the signal in fast pair 12*d*, ultimately reaches the end of cable 10 closer in time to the slower pair 12*a* (which uses a basic FEP insulation.)

For example, basic FEP has a dielectric constant of roughly 2.07 which is used on pairs 12*a*-12*c*. However, with the additives added to FEP insulation 14 on pair 12*d*, the effective dielectric constant is increased to roughly 2.3. These additives achieve this change as outlined in more detail below.

One property that is necessary to watch is the stability of the additive to the FEP insulation 14 on pair 12*d*, because FEP is extruded at a high temperature. For example, FEP has a high melting temperature, substantially ~260° C., and an even higher processing temperature, ~360.0 or above (to achieve a low enough viscosity for high speed extrusion).

However, most organic materials, including most polymers, deteriorate at these high temperatures making them unsuitable for use as an additive. However, most inorganic materials can be used at very high temperatures, often above 500° C., making them ideal for use as the additive from a processing standpoint.

As such, in the present arrangement, inorganic materials are used to adjust the dielectric constant of FEP in coating 14 of pair 12*d*. Such inorganic materials have a lower cost as compared to the price of the FEP into which they are incorporated making this process cost effective. Additionally, unlike most organic polymers and polymer additives, most inorganic additives do not degrade the fire performance of FEP, which allows the cables that use such additives in the coating 14 of one of the pairs (12*d*) to maintain their plenum rating; such as the fire rating associated with the NFPA 262 flame test.

In a first arrangement, the electrical properties of FEP (or other fluoropolymers) are modified by introducing inorganic additives into the polymer, selected from the group consisting of calcium carbonate or talc oxide. This composition is then extruded onto the wires as coating 14 of twisted pair 12*d*. In another embodiment, other additives such as zinc oxide and calcium fluoride may also be used. In yet another embodiment, secondary polymers, having at least some limited compatibility with FEP, such as PTFE [Ethylene Tetrafluoroethylene] and ECTFE [Ethylene Chlorotrifluoroethylene], may be blended with the FEP in coating 14 of pair 12*d*, to obtain similar increases in the dielectric constant of the "fast" pair. Other high temperature polymers like silicone may also be used as the additive for coating 14 of pair 12*d*. In each case, the additives when incorporated into coating 14 of pair 12*d*, raise the dielectric constant and thus decrease the velocity of propagation.

Figure 2:
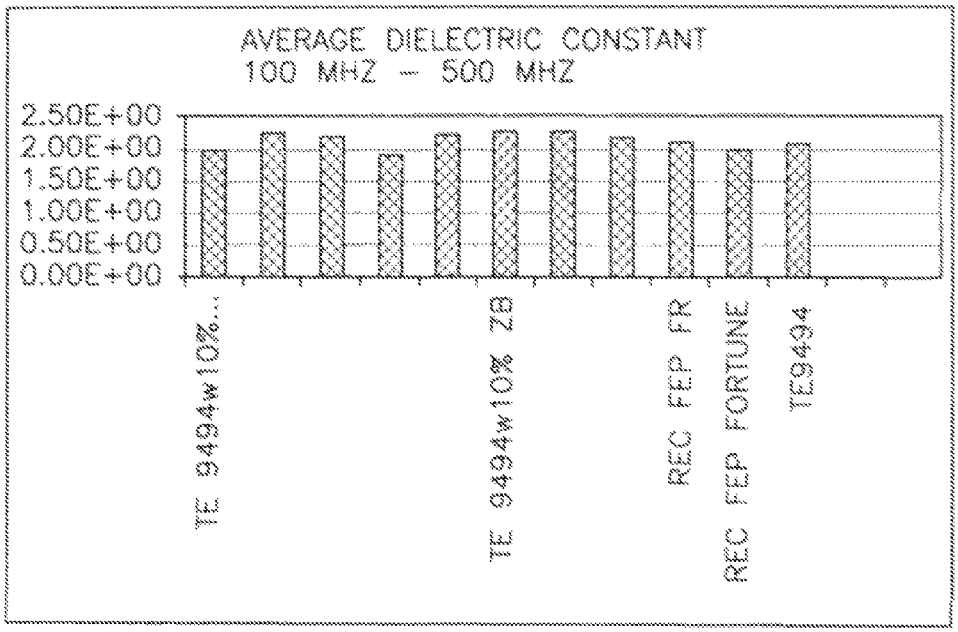
FIG. 2 is a chart comparing the average dielectric constant and average dissipation factor in several embodiments of the present arrangement.
Figure 2:
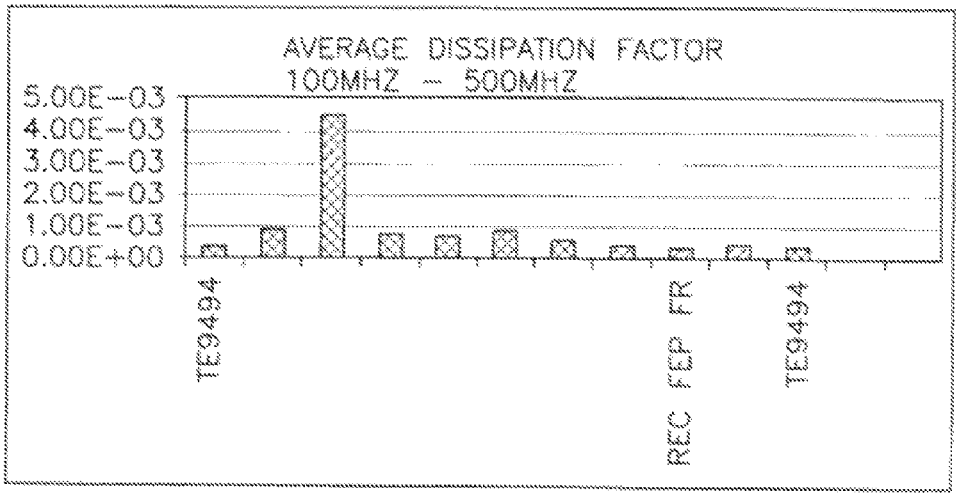

As shown in the table on FIG. 2, laboratory evaluations demonstrate that the dielectric constant of FEP for coating 14 of pair 12*d* is increased from 2.07 to 2.30 with the addition of 10% by weight of calcium carbonate or talc without seriously affecting the dissipation factor. In such an arrangement, when coating 14 for pair 12*d* is being made the FEP is first melted via an internal polymer extrusion mixer, then the calcium carbonate or talc was added, prior to extrusion.

Also illustrated in FIG. 2, various additives to FEP are compared with respect to their average dielectric constant as well as dissipation factor. It is noted that dissipation factor is another issue, apart from skew that needs to be monitored when making communication cables. The dissipation factor correlates with the insertion loss (attenuation) in a cable. As the dissipation factor increases, there is more signal loss in the cable. Excessive signal loss can lead for example, to a cable failing EIA-TIA (Electronic Industries Alliance-Telecommunications Industry Association) requirements for insertion loss. Different additives used in coating 14 for pair 12*d*, in addition to changing the dielectric constant, may also negatively affect the dissipation factor. As shown in FIG. 2, the specific calcium carbonate and talc chosen in addition to raising the dielectric constant, do not show a significant increase in dissipation factor over the pure FEP.

In another embodiment, FIG. 2 also illustrates that the dielectric constant of FEP may be reduced by incorporating glass spheres in the same manner that the additives are added above. In another arrangement then, glass spheres could be incorporated in FEP coating 14 of pairs 12*a* (or possibly 12*b* and 12*c*), ie the slower twisted pairs, in order to speed up the velocity of propagation therethrough to even further reduce the skew measurements for cable 10. In one arrangement, the addition of glass beads to FEP coating 14 of pair 12*a* (and/or pairs 12*b*-12*c*) may be done in addition to the use of additives in coating 14 of pair 12*d* to increase the dielectric constant.

In one example, glass beads of about 3 micron in diameter are added to coating 14 of pair 12*a* in a ratio of about 90% FEP to 10% glass resulting in a dielectric constant of 1.97 (versus a dielectric constant of 2.07 for FEP alone). This arrangement would speed up the signal passing though the slow pair 12*a* relative to the other pairs 12*b*-12*d* again reducing the skew exhibited in cable 10.

In another embodiment, in addition to using additives to increase the dielectric constant (in pair 12*d*) or decrease the dielectric constant (in pair 12*a*), it is also contemplated that different polymers may be used for the different coatings 14 of pairs 12, where the polymers have different dielectric constants. For example, some polymers used for coatings 14 may include the following, each having a dielectric constants typically falling in the listing rages: PE (Polyethylene) 2.2-2.4; PP (Polypropylene) 1.5; PTFE (Polytetrafluoroethylene) 2.0; and PA polyamide 2.5-2.6.

In one arrangement, for pair 12*d*, instead of using an additive to slow the propagation speed to reduce skew, the polymer used for coating 14, for that pair 12*d*, can be changed from FEP to a different polymer exhibiting a higher dielectric constant. Likewise, instead of using an additive like a glass sphere to increase the propagation speed to reduce skew, the polymer used for coating 14, for that pair 12*a*, can be changed from FEP to a different polymer exhibiting a lower dielectric constant. It is noted that dielectric constants may vary from one polymer to the next and even vary within a single polymer class depending on its specific formulation; however, any such use of polymer selection for the purpose of reducing skew between pairs 12 in cable 10 is within the contemplation of this invention. Moreover, it is likewise within the contemplation of this invention that the use of different polymers for coatings 14 of pairs 12 may also be used in combination with the use of additives (both for lowering and raising the dielectric constant) so as to achieve the best propagation velocity balance (lowest skew) between pairs 12.

In each of the above arrangements, it is noted that additional additives such as compatibilizers or lubricants may be added to the composition if necessary to help with the compatibility between the FEP and the additives. For example, such additives would be typically added during the compounding process, and include fluorinated rubbers, acrylic rubbers, thermoplastic elastomers, fluorinated polymers, acrylic polymers, polycarbonate, and polyethylene, provided such additives do not significantly adversely affect the improved skew results achieved above.

As a result of the above described features, the present arrangement, by modifying the FEP composition of coating 14 for the fastest pair 12*d* (having the longest lay length) provides a significant advantage over prior art LAN type data communication cables, particularly with its ability to prevent skew by slowing down the signal speed with the fastest twisted pair without compromising other physical/mechanical properties of the insulation and without added expensive processing.

In another embodiment, instead of using additives to slow down the propagation velocity in the fastest pair 12*d* of cable 10 or speed up the propagation velocity in the slowest pair 12*a* of cable 10, as discussed above, it may be desirable to adjust the propagation velocity of two or more of the pairs 12*a*-12*d* to even further reduce the amount of skew in cable 10.

As noted above, because pair 12*d* has the longest lay length, signals propagated through pair 12*d* are travel the fastest and because pair 12*a* has the shortest lay length, signals propagated through pair 12*a* are travel the slowest, making these two pairs the greatest contributor to the overall skew measurement for cable 10. However, ideally, there would be no skew at all between the pairs 12 in cable 10, including middle pairs 12*b* and 12*c*.

For example, in a cable 10 of 1,000', each of twisted pairs 12 would necessarily need to exceed 1,000' in length because they are twisted. For example, assuming normal sized copper conductors/insulation for LAN cables, and the lay lengths above for pairs 12*a*-12*d*, approximately 1,010' of wire would be needed for each wire in pair 12*d* having the longest lay length, approximately 1,030' of wire would be needed for each wire in pair 12*a* having the shortest lay length, with some amount in between needed for pairs 12*b* and 12*c*.

As a result, a signal travelling down longest lay length pair 12*d* would arrive about 2% sooner than a signal travelling down shortest lay length pair 12*a*. According to most testing standards, there is a requirement that for a 100 meter length of cable 10, the time difference it takes for a signal to travel from one end of cable 10 to the other, between any two pairs 12*a*-12*d* cannot exceed 45 nanoseconds.

As such, in one arrangement, in addition to slowing the rate of propagation in pair 12*d* by adding additives to coating 14 or using a different polymer having a higher dielectric constant for coating 14 so that the total skew between pair 12*a* and pair 12*d* is acceptable, it may be desirable to use additives or different polymers for pair 12*c* (having the second longest lay length) to also get pair 12*c* closer to pair 12*a* as well. Modifications to pair 12*b* may be likewise made to bring the skew down between pair 12*b* and 12*a*. As an alternative, additives such as glass spheres or use of polymers having lower dielectric constants may be used in pair 12*a* as well as pair 12*b* (to a lesser extent) so that they come closer in skew measurement to pairs 12*c* and 12*d*. In another alternative, additives, polymer selection of lower dielectric constants or a combination of the two can be used for coatings 14 of slower pairs 12*a* and 12*b* in combination with additives, polymer selection of higher dielectric constants or a combination of the two used for coatings 14 of faster pairs 12*c* and 12*d*. This results in a signal speed, per unit length of cable 10 being equalized for each of pairs 12*a*-12*d*.

While only certain features of the invention have been illustrated and described herein, many modifications, substitutions, changes or equivalents will now occur to those skilled in the art. It is therefore, to be understood that this application is intended to cover all such modifications and changes that fall within the true spirit of the invention.

What is claimed is:

1. A cable, comprising:

a first twisted pair of insulated conductors, said first twisted pair having a first lay length the insulation of the conductors of said first twisted pair being a non-foamed insulation;

a second twisted pair of insulated conductors, said second twisted pair having a second lay length, the insulation of the conductors of said second twisted pair being a non-foamed insulation, wherein said second lay length is longer than said first lay length;

at least one jacket covering said pairs, said cable further comprising third and fourth insulated conductor twisted pairs, said pairs having respective lay lengths between said first and said second lay length of said first and second pairs respectively, wherein the insulation of the conductors of said first twisted pair is FEP and the insulation of the conductors of said second twisted pair is a composition comprising one polymer selected from polyethylene, ETFE, ECTFE, silicone and polyamide, and one inorganic additive, said inorganic additive and said polymer being suitable for raising the dielectric constant of the insulation of the conductors of said second twisted pair relative to the dielectric constant of the insulation of the conductors of said first twisted pair resulting in a reduced skew between said first and second twisted pairs, and wherein said inorganic additive is selected from the group consisting of calcium carbonate, talc, zinc oxide, calcium fluoride, mica and zinc borate, and wherein said inorganic additive added to said insulation of the conductors of said second twisted pair has no substantial effect on the dissipation factor of said insulation.

2. A cable, comprising:

a first twisted pair of insulated conductors, said first twisted pair having a first lay length the insulation of the conductors of said first twisted pair being a non-foamed insulation;

a second twisted pair of insulated conductors, said second twisted pair having a second lay length, the insulation of the conductors of said second twisted pair being a non-foamed insulation, wherein said second lay length is longer than said first lay length;

at least one jacket covering said pairs, said cable further comprising third and fourth insulated conductor twisted pairs, said pairs having respective lay lengths between said first and said second lay length of said first and second pairs respectively, wherein the insulation of the conductors of said first twisted pair is a fluoropolymer and the insulation of the conductors of said second twisted pair is a composition comprising said fluoropolymer and one inorganic additive, wherein said inorganic additive is included in the insulation of the conductors of said second twisted pair so that the dielectric constant of the insulation of the conductors of said second twisted pair is raised, wherein there is a skew between signals traveling through said first twisted pair and said second twisted pair, wherein said inclusion of said inorganic additive in said insulation of the conductors of said second twisted pair results in said skew being lower than a skew that would result between said first twisted pair and a second twisted pair of the same said second lay length and said second insulation that does not have the inorganic additive, and wherein said inorganic additive is selected from the group consisting of calcium carbonate, talc, zinc oxide, calcium fluoride, mica and zinc borate, and wherein said inorganic additive added to said insulation of the conductors of said second twisted pair has no substantial effect on the dissipation factor of said insulation.

3. The cable as claimed in claim 2 wherein, the lay length of said third pair is longer than said first pair and shorter than said second and fourth pair, and wherein the lay length of said fourth pair is longer than said first and third pairs and shorter than said second pair, wherein additives are added to the insulation of said fourth twisted pair to increase the dielectric constant.

4. The cable as claimed in claim 2, wherein the insulation of said first twisted pair is FEP, and the insulation of said second twisted pair is a composition including FEP and said inorganic additive.

* * * * *